US006173782B1

(12) United States Patent
Watkins

(10) Patent No.: US 6,173,782 B1
(45) Date of Patent: Jan. 16, 2001

(54) CABLE CONNECTOR

(75) Inventor: Bruce J. Watkins, Houston, TX (US)

(73) Assignee: Dril-Quip, Inc., Houston, TX (US)

( * ) Notice: Under 35 U.S.C. 154(b), the term of this patent shall be extended for 0 days.

(21) Appl. No.: 09/363,596

(22) Filed: Jul. 29, 1999

(51) Int. Cl.[7] ..... E21B 7/12
(52) U.S. Cl. ..... 166/367; 405/224.2
(58) Field of Search ..... 166/355, 367, 166/350, 351, 368; 405/190, 224.2

(56) References Cited

U.S. PATENT DOCUMENTS 3,493,043 * 2/1970 Watkins ..... 166/341
3,517,738 * 6/1970 Petersen ..... 166/349
3,709,291 * 1/1973 Hnaes et al. ..... 405/191
4,024,718 * 5/1977 Roche et al. ..... 405/190
4,272,059 * 6/1981 Noerager et al. ..... 254/392
4,540,314 * 9/1985 Falkner, Jr. ..... 405/227

* cited by examiner

*Primary Examiner*—Frank Tsay
(74) *Attorney, Agent, or Firm*—Browning Bushman

(57) ABSTRACT

There are disclosed two embodiments of a connector for use in supporting a riser from cable which extend about sheaves intermediate the riser and a tensioning device located on a floating rig above a subsea wellhead to which the lower end of the riser is to be anchored. Each connector is of such construction that the cable may be advanced through an opening in a body of the connector in order that the wear point on the cable where it passes over the sheave may be changed from time to time without having to detach and reattached it from and to the riser.

6 Claims, 3 Drawing Sheets

CABLE CONNECTOR

BACKGROUND OF THE INVENTION

This invention relates generally to a connector for use in supporting a riser from cables which extend about sheaves intermediate the riser and a tensioning device located on a floating rig above a subsea wellhead to which the lower end of the riser is to be anchored. More particularly, it relates to improvements in connectors of this type in which the wear point on the cable where it passes over the sheave may be changed from time to time.

Heretofore, this has required that the lower end of each cable be detached from the riser connector and advanced to change the wear point, and a portion of its lower end removed to permit the cable to be reattached to the riser. The attachment and detachment of the cable is a difficult task due not only to the location of the connectors, but also because of the size of the cables, which are often 2 to 2½" in diameter.

SUMMARY

The object of this invention is to provide a connector of this type in which the cable may be advanced without having to detach and reattach it from and to the riser, particularly from a remote location, as, for example, from the drill floor.

These and other objects are accomplished, in accordance with the illustrated embodiment of the invention, by a connector which comprises an elongate body having means on its lower end for pivotal attachment to the riser, a longitudinal opening having an upper end to receive the lower end of the cable for extension therethrough, and first gripping means surrounding the cable and supported and arranged within the body opening to grip the cable, and thus support the riser therefrom, in response to the application of upward force to the gripping means. The connector further comprises actuator means having a sleeve surrounding the cable for vertical reciprocation within the body opening between upper and lower positions, and second gripping means supported and arranged within the sleeve to slide over the cable, as the sleeve is moved from its lower to its upper position, and the cable is supported from the first gripping means, and then grip and lower the cable through the first gripping means, as the sleeve is moved downwardly within the body to its lower position. More particularly, means are provided for selectively moving the sleeve means between its upper and lower positions, whereby the sleeve need only be raised and then lowered to lower a desired length of cable through the body opening, and thus change its wear point on the sheave, without need for its detachment and reattachment of its lower end to the connector.

In one embodiment of the invention, the upward force results at least in part from the application of tension to the upper end of the cable. In those instances in which that may not be sufficient, and in accordance with an alternative embodiment of the invention, an auxiliary piston is provided beneath the first gripping means and sealably slidable within the body opening to form a pressure chamber having a downwardly facing pressure responsive piston surface. A port is also provided in the body through which pressure fluid may be supplied to the chamber, in order to add to the upward force due to tension on the cable by lifting the first gripping means, following which it may be exhausted therefrom to permit the first gripping means to as the move downwardly with the cable.

In the preferred and illustrated embodiments of the invention, the sleeve is a piston sealably slidable within the body opening to form upper and lower chambers having upwardly and downwardly facing pressure responsive surfaces, respectively, and the means for moving the sleeve comprises ports in the body through which pressure fluid may selectively be supplied to or exhausted from each of the chambers. More particularly, the piston has an upper cylindrical portion sealably slidable within an upper cylindrical portion of the body opening, an intermediate enlarged diameter cylindrical portion sealably slidable within an intermediate cylindrical portion of the body opening to form the upper pressure chamber, and a lower reduced diameter cylindrical portion sealably slidable with a lower cylindrical portion of the body opening to form the lower pressure chamber.

As also shown, the body preferably has a side recess beneath the lower open end of the opening which has a curved wall against which the cable is guidably slidable.

BRIEF DESCRIPTION OF THE DRAWINGS

In the drawings, wherein like reference characters are used throughout to designate like parts.

DESCRIPTION OF THE PREFERRED EMBODIMENTS

With reference now to the details of the above described drawings, the riser R is shown to extend downwardly from drilling equipment 11 within a well of a floating platform for connection at its lower end to a subsea well (not shown) during drilling operations. The upper end 12 of a joint of the riser which is supported from a pair of connectors 10 on the lower ends of cables C each of which extends about a sheave 15 mounted on the platform. As well known in the art, the upper ends of the cables extend to suitable devices (not shown) for applying tension to the cables. Over time, the portion of the cable which extend over the sheave will become worn, thereby necessitating that the cable be extended, and, as previously indicated, in the past, this has required detachment and reattachment of the end of the cable to the connector.

Figure 1:
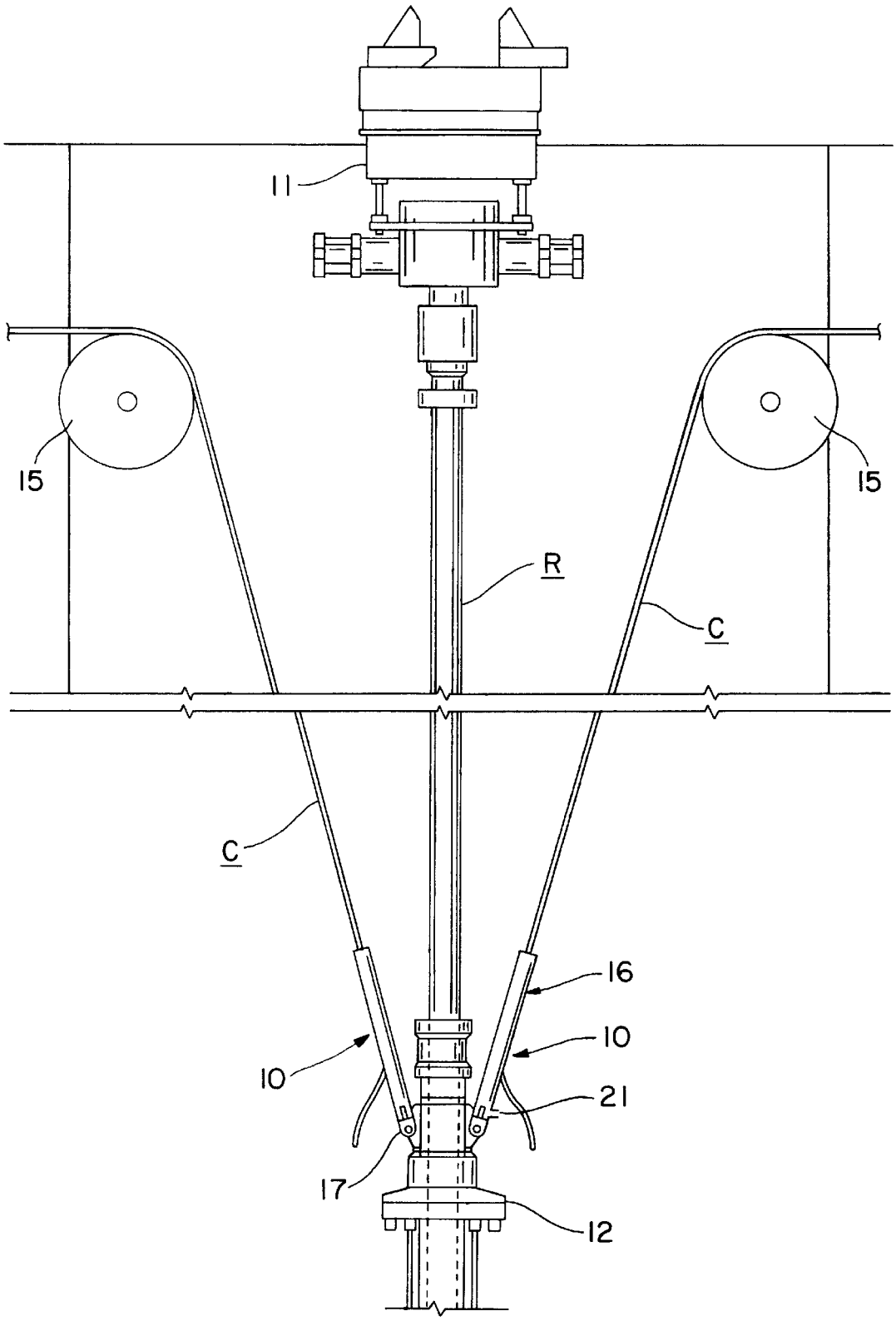
FIG. 1 shows a drilling riser suspended from a floating drilling rig by means of cables which extend over sheaves at the surface intermediate a tensioning device and connectors at their lower ends which are constructed in accordance with the present invention.
Figure 3:
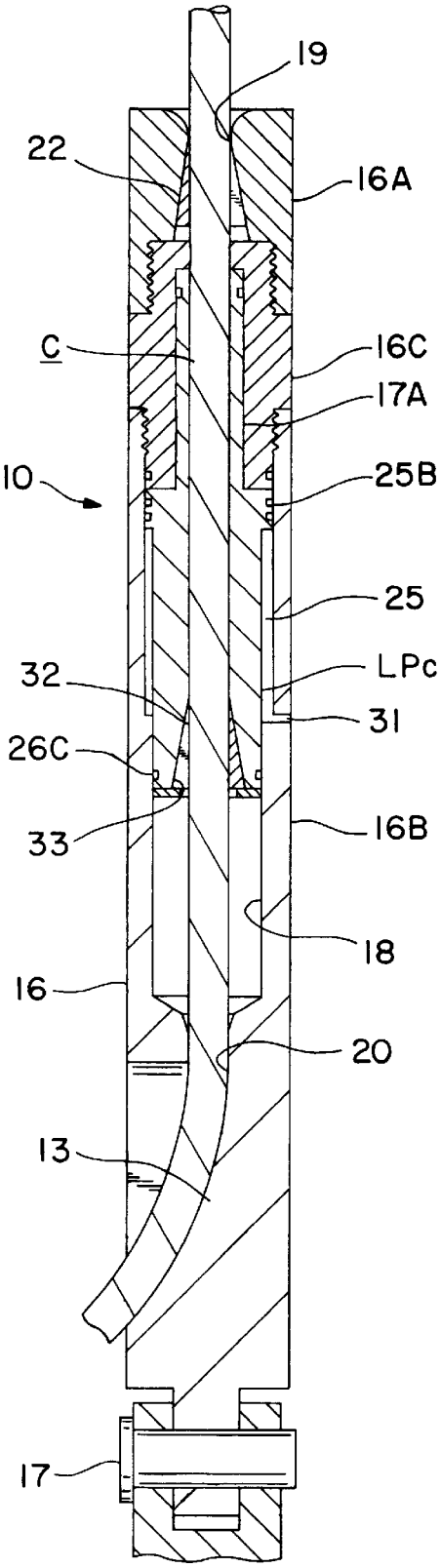
FIG. 3 is a view similar to FIG. 2, but in which the piston has been moved upwardly over the cable to a position to cause the second slip means to move upwardly to a position on which it will grip and lower the cable upon return of the sleeve to its lower position of FIG. 2.
Figure 2:
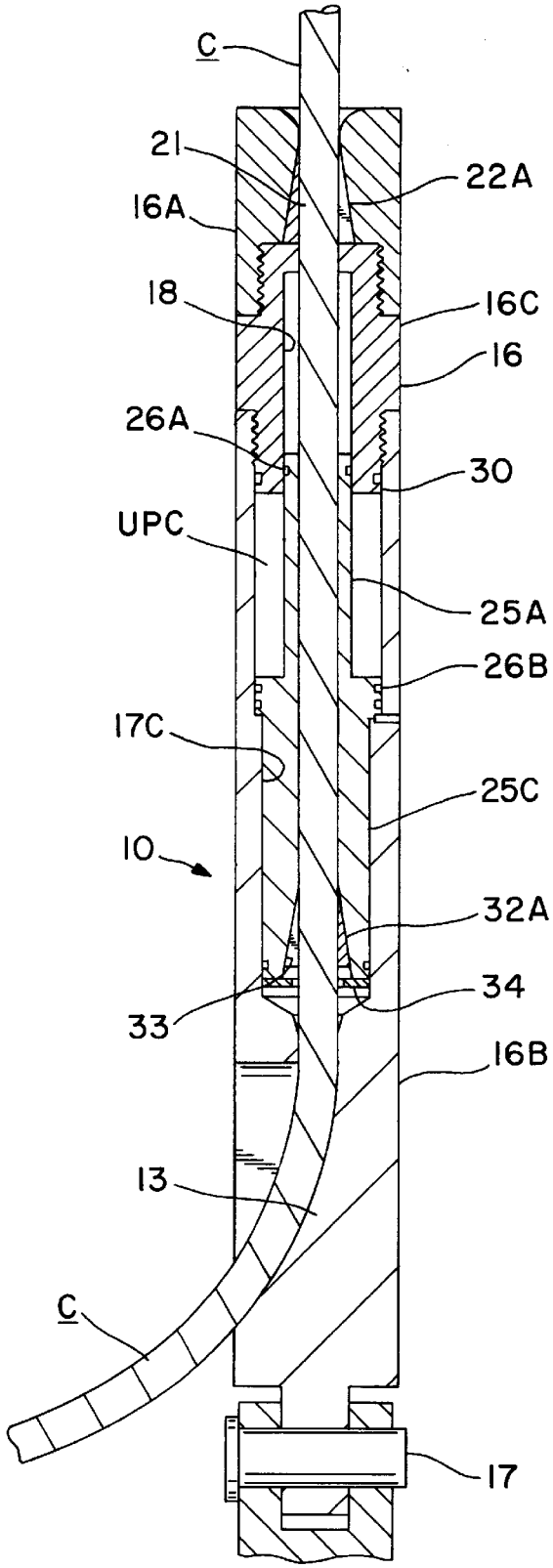
FIG. 2 is an enlarged, vertical sectional view of one of the connectors showing a cable extending through the first slip means, the actuator piston in its lower position, and the second slip means in its lower position within the piston.

As best shown in FIGS. 2 and 3, each connector of the first embodiment comprises an elongate body 16 having means 17 at its lower end for pivotal connection to the upper end 12 of the riser section and a longitudinal opening 18 to receive the cable C for extension therethrough. As shown, the opening has holes 19 and 20 in its upper and lower ends through which the cable may be extended, and the free lower end of the cable is guidable received in a side recess 13 beneath the lower opening and curved to guide the free end outwardly away from the riser.

The connector body 16 includes an upper end section 16A in which the hole 19 is formed, a lower end section 16B in which the hole 20 is formed, and a mid section 16C threadedly connecting the upper and lower sections in end to end relation. The opening in the upper body section has a downwardly and tapered conical recess 21 beneath its upper end to receive gripping means 22 in the form of circumferentially spaced apart, upwardly wedge-shaped slips 22A whose outer surfaces are adapted to slide over recess 21 as the slips are moved between the upper position of FIG. 3 in which they are wedged in the recess to tightly grip and support the cable, and the lower position of FIG. 2 in which their lower ends are supported on the upper end of the intermediate body section 16C in which they lightly grip the cable. Thus, with tension maintained on the upper end of its cable, the connector and riser section are supported therefrom. On the other hand, when the cable has been freed to advance, as will be described, the slips move downwardly onto the surface on body section 16C.

A sleeve in the form of a piston 25 is vertically reciprocable within the body opening and includes an upper portion 25A slidable within opening portion 17A of the intermediate body section 16C, an enlarged intermediate portion 25B slidable with an enlarged diameter opening portion 17B of the body opening beneath the portion 17A, and a lower reduced portion 25C slidable within the reduced diameter opening portion 17C in the intermediate body section. The upper end of the piston portion 25A carried a seal ring 26A for sealably sliding within the opening portion 17A, the portion 25B of the piston carries one or more seal rings 26B for sealably slidable within the opening portion 17B, and the portion 25C a seal ring 26C for sealably sliding within reduced diameter opening portion 17C.

The piston is vertically reciprocable between the upper position of FIG. 3 in which the upper end of its enlarged portion 25B engages the lower end of the body section 16A, and the lower position in FIG. 2 wherein the lower end of piston portion 25C rests upon shoulder on the reduced diameter portion 17B of the opening. Thus, an upper pressure chamber UPC is formed between the upwardly facing piston portion 25B and the lower downwardly facing end of the portion 17B, and a lower pressure chamber LPC is formed between the downwardly facing surface on the lower end of piston portion 25B and the upwardly facing surface on the upper end of opening portion 17C. More particularly, ports 30 and 31 are formed in the connector body to connection with chambers UPC and LPC so that pressure fluid may be selectively supplied to or be exhausted from them in order to move the piston between its upper and lower positions.

A conically tapered second or lower gripping means 32 comprises circumferentially supported slip segments 32A received within a downwardly extending conical recess 33 formed in the lower end of the piston opening. More particularly, the lower slips are adapted to shift between the upper position of FIG. 2 in which they are wedged by the conical recess into tight gripping engagement with the cable, and the lower position of FIG. 3 in which they are supported by a ring 34 carried by the lower end of the piston in which the slips have moved out of tight gripping engagement with the cable.

With the piston in the upper position, as shown in FIG. 3, the upper slips are engaged with the cable to support the connector and thus the riser therefrom. When the piston is moved to its lower position, as shown in FIG. 2, the lower slips grip the cable to lower it with the piston and thus move its wear point on the sheave. However, the upper slips 22A continue to grip the cable sufficiently tightly to support the connector and riser. In this regard, the large piston area of chamber UPC applies a relatively large force to be applied to the cable to lower it through the upper slips, while raising of the piston requires relatively small force from pressure supplied to the lower chamber.

At this time, the piston may be moved back upwardly over the cable back to its FIG. 3 position, so that the upper slips 22A are wedged into tight engagement with the cable to support the body of the connector therefrom as tension is applied to the cable. During this, the lower slips 32A are free to move downwardly to their supported position of FIG. 3.

As previously described, the piston is shifted between its upper and lower positions by means of pressure fluid alternately supplied to exhausted from the upper and lower chambers through upper and lower ports 30 and 31, including, pressure fluid is exhausted through one port while being supplied through the outer port to move and maintain the piston in either its upper or lower position.

Figure 4:
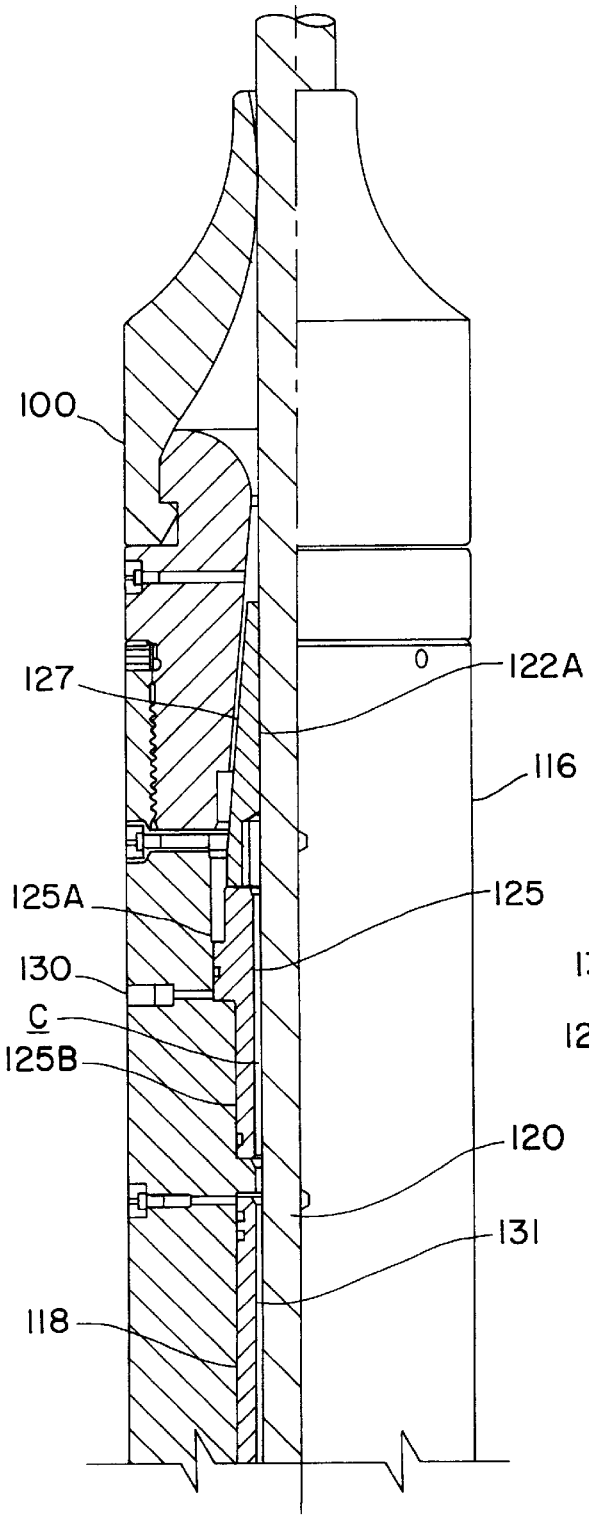
FIG. 4 is a partial view of the upper end of the connector of the alternative embodiment which is similar to that of FIG. 2, but prior to lowering of the sleeve.
Figure 5:
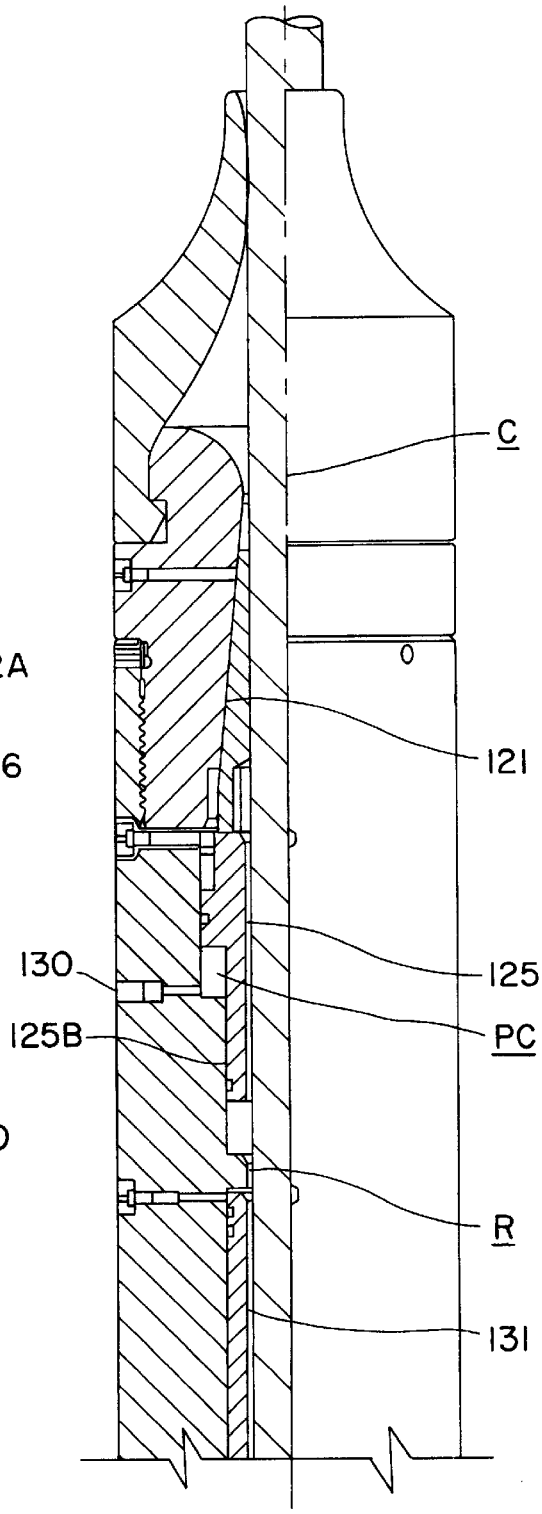
FIG. 5 is another view of the alternate embodiment but in which the upper piston has been moved upwardly as in FIG. 3, but prior to lowering of the sleeve.

As also previously mentioned, the alternate embodiment of the connector shown in FIGS. 4 and 5 is especially well suited for those circumstances in which the lifting of the upper gripping means may not be sufficient to tightly grip the cable in response to the application of tension to the cable. This may, for example, occur because of the construction of the cable. In any event, and again as previously described, this alternate embodiment differs principally from that of the embodiment above described in that the first gripping means is moved upwardly not only in response to tension applied to the cable, but also in response to it being lifted by an upper piston within the connector.

Thus, as shown in FIGS. 4 and 5, the alternate connector 100 includes an elongate body 116, whose upper end is generally similar to the body 16 of the first described embodiment 10, and thus reference is made to the first embodiment for that portion of the connector beneath its upper end.

Thus, the connector body 116 has an opening therethrough providing upper and lower holes each to receive the cable C. The upper hole having a downwardly tapered conical recess 121 to receive first gripping means in the form of circumferentially spaced apart slip segments 122A whose outer surfaces are adapted to slide over the recess 121 as the slips are moved between the upper position of FIG. 5 and the lower position of FIG. 4. In their upper position, the slips are wedged in the recess to tightly grip and support the cable and provide an upward force which aids in supporting the cable, and, in their lower position of FIG. 4, they are supported on a piston (to be described) in which they only lightly grip the cable. Thus, when the cable has been freed to advance, as will be described, the slip segments move downwardly to their supported positions.

In this alternate embodiment, as compared to the first described embodiment, the slip segments are supported upon a piston 125 beneath the segments 122A to support them vertically. Thus, the piston 125 includes an upper outwardly enlarged portion 125A sealably slidable within an enlarged portion of the body opening, and a lower reduced outer diameter portion 125B sealably slidable within a reduced diameter lower portion of the upper end of the opening. The outer diameters of the upper and lower portions of the piston carry seal rings which form a pressure chamber PC beneath the lower end of the enlarged portion, and pressure fluid is adapted to be introduced to or relieved from that chamber through a port 130 in the body of the connector. As will be appreciated, and as above described, the application of pressure to the chamber will raise the piston, and thereby raise the slips, as the cable itself is raised, to cause the upper slip segments to be wedged between the upper surfaces 127 and the cable, as shown in FIG. 5, thereby supporting the connector from the cable.

These partial views of the alternate embodiment of the connector also show the end of sleeve 131 which is slidable within the body opening beneath the piston 125 and of generally the same inner and outer diameters as the lower end 125B of the piston 125. The piston and sleeve are separated by a restriction R in the opening of the body. The lower end of the lower piston 131 may be of generally the same construction as the lower end of the sleeve of the first embodiment, whereby the sleeve may be raised to its upper position as in FIG. 4. The sleeve is lowered by exhaustion of pressure fluid from the pressure chamber about its mid portion and introduction of such fluid to the upper chamber, whereby the lower slips are wedged tightly about the cable, as in FIG. 5.

From the foregoing, it will be seen that this invention is one well adapted to attain all of the ends and objects herein above set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For use in supporting a riser from cables each of which extends over sheaves intermediate the riser and a tensioning device located on a floating platform above a subsea wellhead to which the lower end of the riser is to be anchored, a connector each comprising:

an elongate body having means on its lower end for pivotal attachment to the riser, and a longitudinal opening having an upper end to receive the lower end of the cable for extension therethrough, first gripping means surrounding the cable and supported and arranged within the body opening to grip the cable in response to the application of upward force to the gripping means, and actuator means including a sleeve surrounding the cable for vertical reciprocation within the body opening between upper and lower positions, and second gripping means supported and arranged within the sleeve to slide over the cable, as it is moved from its lower to its upper position, and the cable is supported from the first gripping means, and then grip and lower the cable through the first gripping means as the sleeve is moved downwardly within the body to its lower position, and means for selectively moving the sleeve between its upper and lower positions.

2. As in claim 1, wherein the upward force results at least in part from the application of tension to the upper end of the cable.

3. As in claim 2, including:

a piston beneath the first gripping means sealably slidable within the body opening to form a pressure chamber having a downwardly facing pressure responsive piston surface, and means including a part in the body through which pressure fluid may be supplied to the chamber in order to add to the upward force due to tension on the cable by lifting the first gripping means and exhausted therefrom to permit the first gripping means to as the move downwardly with the cable.

4. As in claim 1, wherein the sleeve is a piston sealably slidable within the body opening to form upper and lower pressure chambers having upwardly and downwardly facing pressure responsive surfaces, respectively, and the means for moving the sleeve comprises ports in the body through which pressure fluid may be selectively supplied to or exhausted from each of the chambers.

5. As in claim 4, wherein said piston has an upper cylindrical portion sealably slidable within an upper cylindrical portion of the body opening, an intermediate enlarged diameter cylindrical portion sealably slidable within an intermediate cylindrical portion of the body opening to form the upper pressure chamber, and a lower reduced diameter cylindrical portion sealably slidable with a lower cylindrical portion of the body opening to form the lower pressure chamber.

6. As in claim 1, wherein the body has a side recess beneath the lower open end of its opening which has a curved wall against which the cable is guidably slidable.

* * * * *